US007883593B1

(12) United States Patent
Rose et al.

(10) Patent No.: US 7,883,593 B1
(45) Date of Patent: Feb. 8, 2011

(54) NON-TOXIC PYROTECHNIC DELAY COMPOSITIONS

(75) Inventors: James E. Rose, Bryans Road, MD (US); Magdy Michay, Springfield, VA (US); Jan Puszynski, Rapid City, SD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/315,488

(22) Filed: Nov. 26, 2008

Related U.S. Application Data

(63) Continuation-in-part of application No. 11/650,758, filed on Dec. 15, 2006, now abandoned.

(51) Int. Cl.

| | |
|---|---|
| ***C06B 45/00*** | (2006.01) |
| ***C06B 33/00*** | (2006.01) |
| ***D03D 23/00*** | (2006.01) |
| ***D03D 43/00*** | (2006.01) |
| ***F42D 1/055*** | (2006.01) |
| ***F42B 10/00*** | (2006.01) |
| ***F42B 12/00*** | (2006.01) |
| ***F42B 30/00*** | (2006.01) |
| ***F42B 27/00*** | (2006.01) |

(52) U.S. Cl. ..... 149/37; 149/2; 149/108.2; 149/108.6; 149/109.2; 149/109.4; 102/473; 102/487; 102/488; 102/200

(58) Field of Classification Search ..... 149/37, 149/2, 108.2, 108.6, 109.2, 109.4; 102/473, 102/487, 488, 200
See application file for complete search history.

(56) References Cited

U.S. PATENT DOCUMENTS

| | | | | |
|---|---|---|---|---|
| 2,232,745 | A * | 2/1941 | Udy | 75/569 |
| 3,837,940 | A * | 9/1974 | Spenadel et al. | 149/19.3 |
| 3,890,168 | A * | 6/1975 | Shumway | 148/24 |
| 5,326,732 | A * | 7/1994 | Ogawa | 501/90 |
| 5,356,732 | A * | 10/1994 | Terasaka et al. | 429/52 |
| 5,700,974 | A * | 12/1997 | Taylor | 149/109.6 |

OTHER PUBLICATIONS

M.E.Brown, S.J.Taylor, and M.J. Tribelhorn, Fuel-Oxident Contact in Binary Pyrotechnic Reactions, Propellants, Explosives, Pyrotechnics 23,320-327 (1998).

* cited by examiner

*Primary Examiner*—James E McDonough
(74) *Attorney, Agent, or Firm*—Fredric J. Zimmerman

(57) ABSTRACT

A novel pyrotechnic delay composition for use in metal delay fuse cartridges, including as its primary constituent Si—Al—$Fe_3O_4$ prepared from powdered form. The delay composition yields a progressive burning zone and burns substantially gas-free, is safe to handle, is resistant to moisture and degradation over time, can be incorporated within the confines of existing detonator shells, and poses no environmental hazards.

1 Claim, 5 Drawing Sheets

NON-TOXIC PYROTECHNIC DELAY COMPOSITIONS

This application is a continuation-in-part application of application Ser. No. 11/650,758 filed Dec. 15, 2006, now abandoned.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

The present invention generally relates to pyrotechnic delay compositions that burn slowly to allow for a time lapse before ignition of a primary charge and, more particularly, to novel non-toxic pyrotechnic delay compositions in which no ingredients pose any environmental hazard.

A delay fuse is a known pyrotechnic device designed to give a delay before ignition of a primary charge, or between ignitions of successive charges in an explosive train. Pyrotechnic delay fuses are widely employed in fireworks exhibitions, mining, quarrying and other blasting operations in order to permit sequential initiation of the explosive charges in a pattern. They are also commonly used in artillery applications to afford a number of seconds for the operator to retire from the artillery before it functions, or to time the explosion of an artillery shell.

Existing delay detonator cartridges comprise a metallic shell closed at both ends and containing in sequence a percussion cap, pyrotechnic delay composition, and igniter. The delay composition imposes an ignition delay between the percussion cap and igniter.

FIG. 1 is an illustration of a typical delay cartridge 13. The cartridge 13 (sometimes referred to as a "shell" or "cartridge shell") is screwed into artillery and is sealed by an O-ring 20. The cartridge 13 includes a percussion cap including a primer 12, which is loaded into cartridge 13, and held by a primer holder 10. The percussion primer 12 is in communication through a calibrated orifice disk 14 with an AlA igniter mix 22. A pyrotechnic delay composition 24 is contained after the igniter mix 22, and this composition 24 is held next to an 80-20 (or equivalent) igniter mix 26. Igniter mix 26 is in communication through another orifice disk 14 to output charge(s) 16, which is sealed in its end of the cartridge 13 by a closure disk 18. Thus, when the percussion cap is detonated, primer 12 is ignited and this ignition ignites the AlA ignition mix 22, which in turn ignites delay composition 24. After the pyrotechnic delay composition 24 has burned through, the flame reaches the 80-20 igniter mix 26, which combusts the output charge(s) 16, whereupon the payload explodes.

A large number of burning pyrotechnic delay compositions are known in the art, and generally include mixtures of fuels and oxidizers. There are certain requirements for these compositions. They must burn without creating large amounts of gaseous by-products which would interfere with the functioning of the delay detonator. Moreover, pyrotechnic delay compositions should be safe to handle, from both an explosive and health perspective, and they must be resistant to moisture and degradation over periods of time. They are also subject to volume constraints as they must operate in a wide range of delay detonators within the confines of space available inside existing detonator shells.

A large number of delay compositions consisting of mixtures of fuel and oxidizers are known, e.g. Manganese Delay (MIL-M-21383: Mn—$PbCra_4$—$BaCrO_4$), Tungsten Delay (MIL-T-23132: W—$BaCrO_4$—$KClO_4$—SiO2), T-10 (B—$BaCrO_4$,), etc. See, e.g., M. E. Brown, S. J. Tylor, and M. J. Tribelhorn, *Fuel-Oxidant Particle Contact in Binary Pyrotechnic Reactions*, Propellants, Explosives, Pyrotechnics 23, 320-327 (1998). Unfortunately, these existing ignition delay mixtures are not environmentally friendly due to the toxicity of individual components. For example, Manganese Delay (MIL-M-21383) or Tungsten Delay (MIL-T-23132) and other similar pyrotechnic delay compositions contain carcinogenic hexavalent chromates. Silicon and barium sulphate delay compositions include a proportion of red lead oxide, also carcinogenic. There is a significant desire in the explosives industry to eliminate all use of lead or other toxins and carcinogenics as compounds in delay compositions.

Recently it was found that Si—Al—$Fe_3O_4$ could be considered as a potential replacement for commercial formulations. This mixture appears to be very safe when tested by impact or friction and it is rather insensitive to electrostatic discharge. Ignition temperatures are close to 1000° C. The advantages of Si—Al—$Fe_3O_4$ are its insolubility in water and resistance to moisture and that it is environmentally benign. Thus, it would be greatly advantageous to provide a non-toxic pyrotechnic delay composition based principally on Si—Al—$Fe_3O_4$ that burns substantially gas-free, is safe to handle, is resistant to moisture and degradation over time, can be incorporated within the confines of existing detonator shells, and that poses no environmental hazard.

SUMMARY OF THE INVENTION

An aspect of the invention is to provide a non-toxic environmentally-friendly pyrotechnic delay composition blended principally from Si—Al—$Fe_3O_4$ that burns substantially gas-free, is safe to handle, resistant to moisture and degradation over time, can be incorporated within the confines of existing fuse explosive trains, and that poses no environmental hazards.

In accordance with the stated aspects, a novel pyrotechnic delay composition is provided for use in conventional metal delay fuse cartridges, each including a burnable delay composition for providing a progressive burning zone. The burnable delay composition includes as its primary constituent Si—Al—$Fe_3O_4$. More specifically, the pyrotechnic delay composition includes Si—Al—$Fe_3O_4$ in a range of from about 15 wt % Si and about 85 wt % $Fe_3O_4$ to about 35 wt % Si and about 65 wt % $Fe_3O_4$, and more particularly at least about 1 wt % Al, about 29 wt % Si and about 70 wt % $Fe_2O_3$.

The composition burns substantially gas-free, is safe to handle, resistant to moisture and degradation over time, can be incorporated within the confines of existing detonator shells, and poses no environmental hazards.

DETAILED DESCRIPTION OF EXEMPLARY EMBODIMENTS OF THE INVENTION

Figure 1:
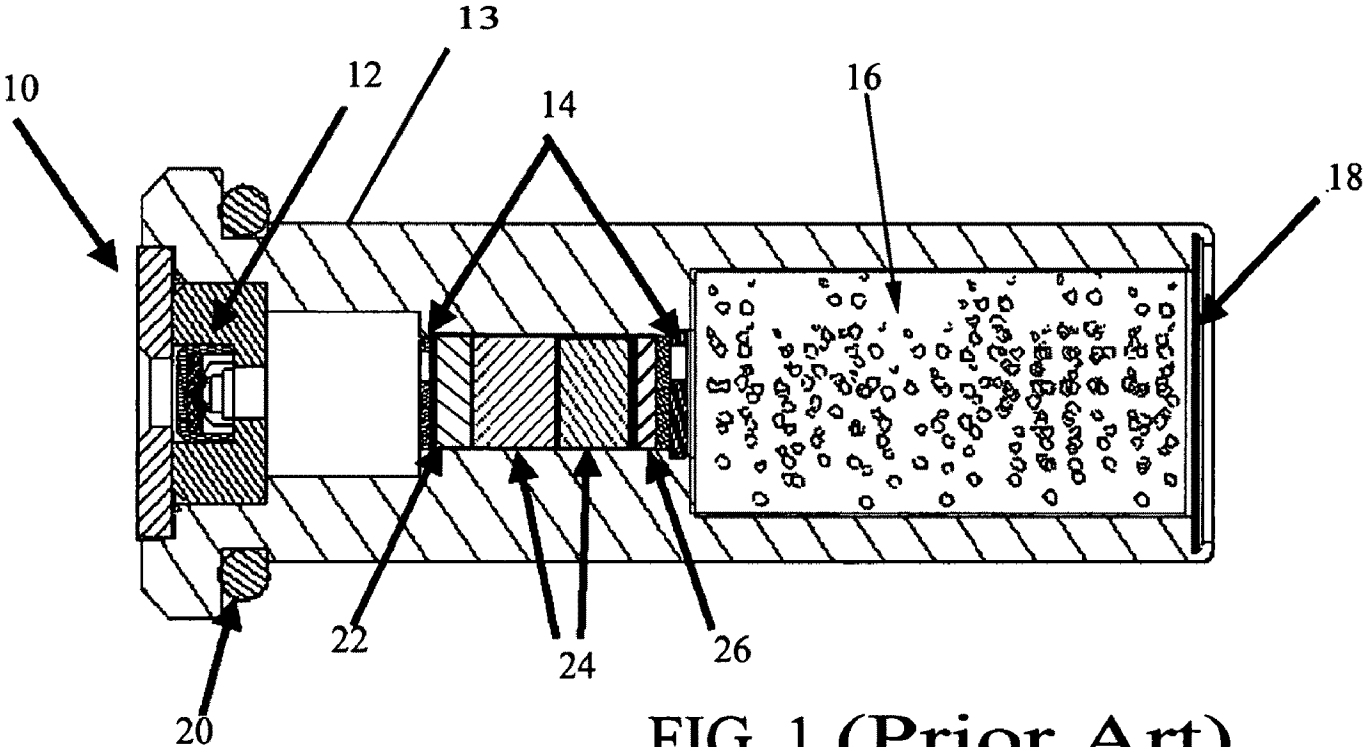
FIG. 1 (Prior Art)
FIG. 1 is a cross-section of a typical delay cartridge.

The present invention includes s a non-toxic pyrotechnic delay composition based principally on a silicon-aluminum-iron oxides mixture and, more specifically, a blend comprising powdered or acicular powdered Silicon, Ferric Oxide powder and Fine Grain Aluminum. The pyrotechnic delay composition of the present invention generally includes powdered or acicular powdered Silicon, Ferric Oxide powder or Ferrosoferric Oxide powder, and Fine Grain Aluminum and, more particularly, Si—Al—$Fe_3O_4$. The blend is formulated to provide an ignition delay system with an average inverse burn rate in the range of 0.0046182-0.005644 m/s. The blend described herein has a consistent burn rate in the range between 0.005 and 0.02 m/s, an activation energy of approximately 227 kJ/mol, is nontoxic and none of the ingredients pose an environmental hazard. This makes an excellent candidate for replacement of conventional pyrotechnic delay compositions. Experimental and modeling studies confirm their performance as herein described. For purposes of description, the following nomenclature will be used.

| | |
|---|---|
| $\eta_p$ | Conversion |
| E | Activation energy, J/kmol |
| R | Universal gas constant, J/mol · K |
| T | Temperature, K |
| $k_o$ | Pre-exponential factor, l/s |
| $\Phi$ | Porosity |
| $v_g$ | Gas velocity, m/s |
| $\rho_g$, $\rho_s$ | Gas and pellet densities, kg/m$^3$ |
| $\lambda$ | Thermal conductivity, W/m · K |
| a, b, c | Gas viral coefficients |
| $Cp_s$, $Cp_g$ | Pellet and gas heat capacities, J/kg · K |
| $\Delta H_{RP}$ | Heat of reaction, J/kmol |
| $W_{frac,Lim}$ | Weight fraction of limiting reactant |
| $M_{Lim}$ | Molecular weight of limiting reactant, kg/kmol |
| $D_p$ | Diameter of particle, m |
| $g_c$ | Conversion factor, 1 kg · m/s$^2$/N |
| $\mu$ | Viscosity of a gas, kg/m · s |
| p | Pressure, Pa |
| G | Superficial mass velocity, kg/m$^2$ · s |
| $\Theta$ | Dimensionless temperature, $(T - T_c)/T_c$ |
| t* | Reference time, s $(\overline{\rho Cp} L^2/\lambda)$ |
| $\tau$ | Dimensionless time, t/t* |
| z | Axial coordinate, m |
| $\Phi$ | Porosity |
| $\Delta p$ | Pressure difference, Pa |
| $\rho^*$ | Dimensionless density, $\rho_g/\rho_{g_o}$ |
| $\gamma$ | Heat capacities ratio, $Cp_g/Cv$ |
| $v_o$ | Speed of sound, $\sqrt{\gamma RT_o}$ |
| $v^*$ | Dimensionless velocity, $v_g/v_o$ |
| $p_o$ | Initial pressure, Pa |
| $p^*$ | Dimensionless pressure, $p/p_o$ |
| L | Length of cylindrical specimen, m |
| $\xi$ | Dimensionless axial coordinate, z/L |
| $p_h$ | Chamber pressure, Pa |
| $T_c$ | Ignition temperature, K |
| $T_o$ | Initial temperature, K |

The Pyrotechnic Delay Composition

An embodiment of the composition is about 1 wt % Al, 29 wt % Si and 70 wt % $Fe_3O_4$, within a range from 15 wt % Si and 85 wt % $Fe_3O_4$ to 35 wt % Si and 65 wt % $Fe_3O_4$. When 15 wt % Si and 85 wt % $Fe_3O_4$ are used propagation starts in Si—$Fe_3O_4$ system at 70 degrees F., however Aluminum is used to increase propagation. Below the value of that composition there is no propagation. Propagation continued in Si—$Fe_3O_4$ system up to 35 wt % Si and 65 wt % Fe3$O_4$. Beyond that range there is no propagation. To prepare the blend, wet mixing of the two reactants takes place in acetone. After mixing for 2 hours, the mixture is sieved three times using a 140-size mesh. The reactant mixture is loaded into aluminum capsules having a diameter of 0.204 inches at a predetermined pressure (for example, 30,000 psi).

All the foregoing reactants are obtained in powder form from commercial suppliers: Silicon (Elkem Metals Company, mean particle diameter 3.6 micron); $Fe_3O_4$ (Columbian Chemicals Company, mean particle diameter 2.9 micron, Aluminum (Valimet, Inc. Grade H-2 aluminum weight average particle diameter about 2-3 microns).

Composition Variables that Effect Burn Rate

Combustion front velocity measurements in a metal cavity (see FIG. 1) (a non-adiabatic condition) in the silicon, aluminum, and iron oxide system have been found to vary between 0.005 and 0.02 m/s depending on the composition of reactants. For example, the combustion front velocity increases with increasing silicon content in the range between 20 and 40 wt % regardless which iron oxide powder was used. Thus, burn velocity is a direct function of composition. In addition, burn velocity is also a function of relative packing density, average particle size of reactants, initial temperature, diameter of the cavity, gas pressure gradients, and capsule design. The specific effects of these variables have been ascertained by experimentation as detailed below:

1. Gas Pressure Gradients

Figure 2:
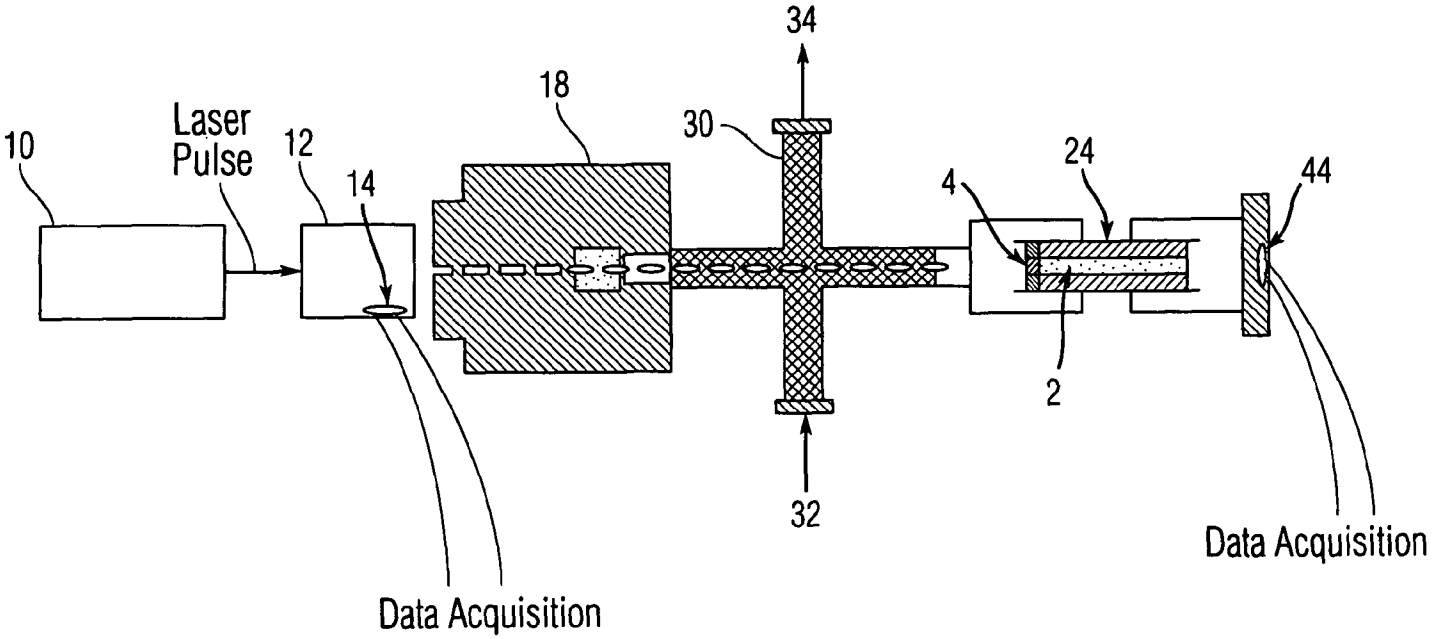
FIG. 2 is an experimental setup for measurement of propagation velocities under uni-axial gas pressure gradients.
Figure 3:
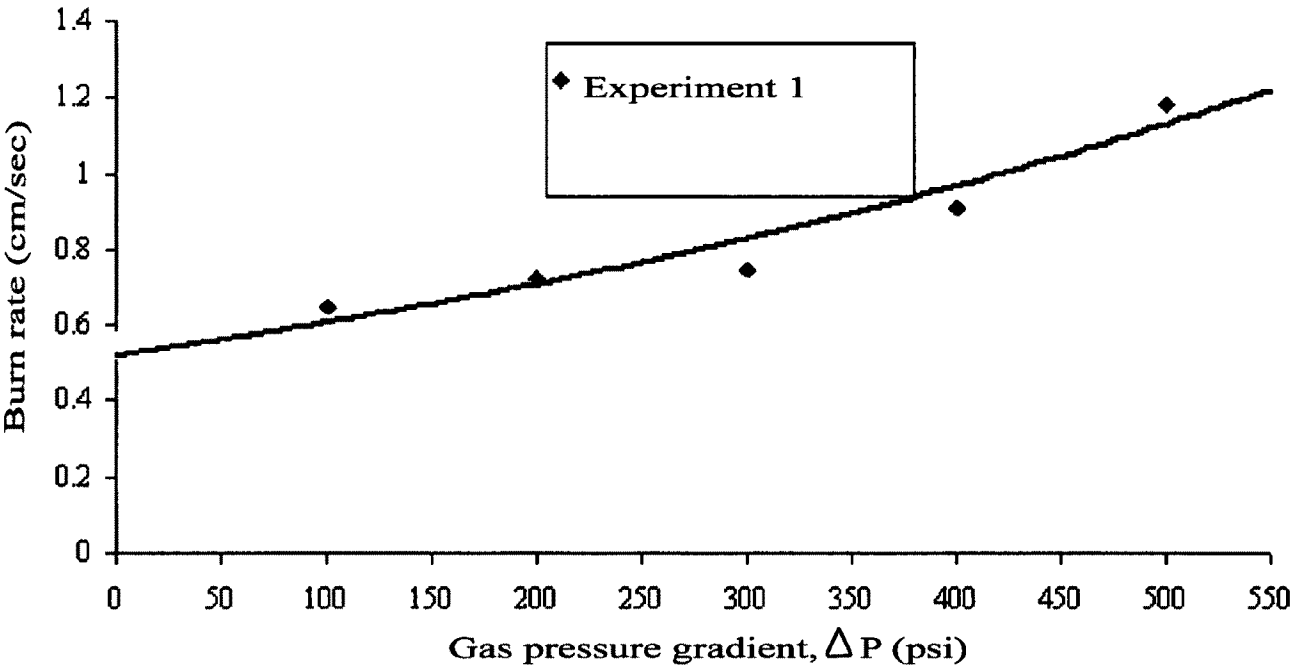
FIG. 3 is a plot of burn rate as a function of gas pressure gradient (psi) showing the effect of gas pressure gradient on propagation velocity in an Al—Si—$Fe_3O_4$ system (composition: 70 wt % $Fe_3O_4$, 28.5 wt % Si, and 1.5 wt % Al).

In an actual close column cartridge, pressure is rapidly built up in the ignition cavity, which causes hot gases to flow through the porous reactant mixture. These hot gases preheat reactants causing faster combustion front propagation. The source of the pressure may be gas output from the ignition source, temperature increase, or desorption of volatile species. In an attempt to better understand the effect of pressure on the burning time, experiments were conducted under uni-axial gas pressure gradients in an Al—Si—$Fe_3O_4$ system. Propagation velocities under uni-axial gas pressure gradients were measured using the experimental setup shown in FIG. 2. A laser source 10 such as an Nd Yag Pulse Laser sends a laser pulse to ignite the above-described pyrotechnic delay mixture 2, which has been pre-mixed and pressed into a steel test capsule 24. The test capsule 24 is also loaded with an igniter charge 4 such as an AlA igniter mixture. The laser first passes through an aluminum test chamber 12 equipped with a photodiode 14 for data acquisition. The laser then passes through a glass window 18 and into a four-way coupling 30, which includes a fluid inlet 32 and pressure relief valve 34 for pressurizing the delay column using argon gas. The laser beam ignites the igniter charge 4, initiating the reaction and sends a first test signal to data acquisition via photodiode 14. The pyrotechnic delay composition 2 burns and upon completion a second photodiode 44 for data acquisition emits a second test signal. The time difference between two test signals allows calculation of the burn rate. Actual results for the Al—Si—$Fe_3O_4$ composition were shown in FIG. 3. It can be seen from FIG. 3 that gas pressure gradient has a significant effect on burn rate (sec/inch).

2. Composition

Composition has an effect on the burning time, and the weight percent of Silicon in the Al—Si—$Fe_3O_4$ system was varied to optimize the burn rate at approximately 4.5 sec/inch. It was found that the lowest limit for Si—$Fe_3O_4$ at 70° F. was 15 wt % of Si. The upper limit was 35 wt % Si. This data resulted in an embodiment of the composition of 30 wt % Si and 70 wt % $Fe_3O_4$, within a range of from 15 wt % Si and 85 wt % $Fe_3O_4$ to 35 wt % Si and 65 wt % $Fe_3O_4$. Addition of aluminum is required in order to increase the velocity of propagation and to ensure propagation of that system at low temperatures as indicated by the test data. More aluminum may be added to the mixture to yield a higher propagation velocity.

3. Loading Pressure

One of the factors to be considered in the performance of ignition delay devices is the loading pressure of the delay mixture. Thus, for comparative testing it is essential to keep loading conditions the same for all samples.

4. Activation Energy

Figure 4:
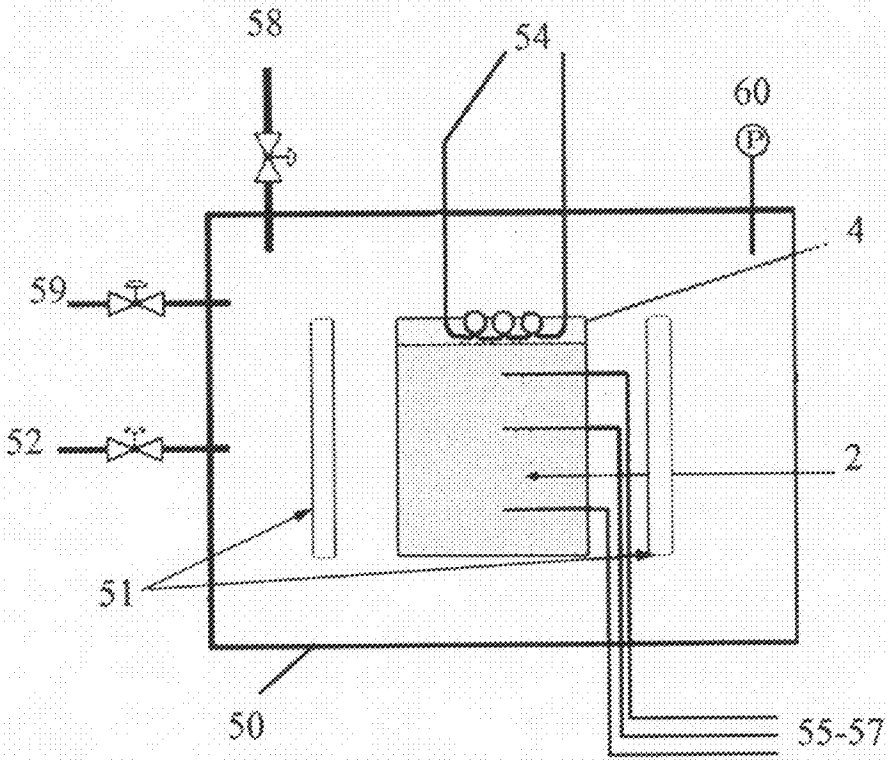
FIG. 4 is a cross-section of a test reactor to determine an activation energy.

To determine activation energy, a test reactor shown in FIG. 4 was built. The test reactor included an aluminum cylinder 50, with exemplary dimensions of 0.55 m in length, 0.33 m in diameter, with flanges at either ends. Cylinder 50 is generally equipped with radiation shields 51 for safety. The reactor was equipped with ports for a molybdenum ignition coil 54, three thermocouples 55-57, an inert gas inlet 58 for argon pressurization, a vacuum inlet 59, and pressure relief safety valve 52, a pressure valve 60 for measurement. The ignition coil 54 may be connected to a variable voltage regulator (not shown) for initiating ignition. Thermocouples 55-57 may be connected to a conventional data acquisition system (not shown) such as is commercially available from IOtech, Inc. The effect of activation energy was tested for the Al—Si—$Fe_3O_4$ ignition delay mixture, which is packed at 2 beneath the igniter 4 (described above). The Al—Si—$Fe_3O_4$ ignition delay mixture of the present invention has an activation energy of approximately 227 kJ/mol, which is suitable for replacement of conventional pyrotechnic delay compositions.

5. Capsule Design

Apparent burn rates can be affected by geometrical factors specific for the cartridge design. Compositions loaded into a small diameter tube burn slower than the same material placed in a cavity with larger diameter. In addition, the heat loss to the wall of the container is less significant for a wide bore tube, relative the heat retained by the composition. The inverse burn rates were measured at room temperature in 0.20 inch and 0.26 inch diameter aluminum capsules are shown in Table 1 (Si—$Fe_3O_4$) and in 0.26 inch diameter aluminum capsules in Table 2 (Al—Si—$Fe_3O_4$). The reactant mixture and loading conditions were the same for all samples.

TABLE 1

Comparison of inverse burn rates for Si—$Fe_3O_4$ in aluminum capsules with two different inside diameters.

| Sample No. | Reactant Mixture Si—$Fe_3O_4$ | Composition (wt %) | Inverse burn rate in 0.20 inch diameter capsule (sec/inch) | Inverse burn rate in 0.26 inch diameter capsule (sec/inch) |
|---|---|---|---|---|
| 1 | | | 5.91 | 4.85 |
| 2 | | | 5.86 | 4.81 |
| 3 | $Fe_3O_4$ | 70 | 5.88 | 4.83 |
| 4 | Si | 30 | 5.87 | 4.88 |
| 5 | | | 5.95 | 4.91 |
| Mean | | | 5.89 | 4.86 |
| Standard Dev. | | | 0.036 | 0.039 |
| CV | | | 0.611 | 0.802 |

TABLE 2

Comparison of inverse burn rates for Al—Si—$Fe_3O_4$ in aluminum capsules with two different inside diameters.

| Sample Number | Reactant Mixture Al—Si—$Fe_3O_4$ | Composition | Inverse Burn Rate in 0.26 inch diameter capsule (sec/inch) |
|---|---|---|---|
| 1 | | | 5.5 |
| 2 | | | 5.7 |
| 3 | $Fe_3O_4$ | 70 wt % | 5.4 |
| 4 | Si | 29 wt % | 5.3 |
| 5 | Al | 1 wt % | 5.5 |
| 6 | | | 5.7 |
| 7 | | | 5.3 |
| 8 | | | 5.6 |
| 9 | | | 5.8 |
| 10 | | | 6.0 |
| Mean | | | 5.58 |
| SD | | | 0.22 |
| ( % CV) | | | 4.03 |

The present inventors have also experimented with igniter 4 (AlA), packing it on one side of the delay composition 2 as well as on both sides. It was found that the inverse burn rates are almost same in both cases.

6. Simulations

In addition to the empirical results obtained above, the present inventors have employed mathematical modeling to simulate the combustion wave propagation in condensed reacting systems, both with and without the presence of uniaxial gas pressure gradient. The models (described below) assume that the pressure drop along a cylindrical specimen can be described by the Ergun equation as stated by H. S. Fogler, *Elements of Chemical Engineering*, $3^{rd}$, (1999). The models also assume gasless and elementary character of the combustion process. This reaction can be represented as:

$$A(\text{solid})+B(\text{solid})\rightarrow P(\text{solid})$$

The governing equations describing the condensed-phase reacting system under adiabatic conditions for the semi-finite cylindrical body are:

Mass Balance $$\frac{\partial \eta_p}{\partial t} = \varphi(\eta_p, T) \tag{2}$$

Where, $\phi(\eta_p,T)$ is heat released function and it is defined as:

$$\varphi(\eta, T) = k_o(1-\eta_p)\exp\left(-\frac{E}{RT}\right) \tag{3}$$

Energy Balance $$\overline{\rho Cp}\frac{\partial T}{\partial t} + v_g\rho_g Cp_g\frac{\partial T}{\partial z} = \frac{\partial}{\partial z}\left(\lambda\frac{\partial T}{\partial z}\right) + \frac{\rho_s W_{frac,Lim}}{M_{lim}}(-\Delta H_{Rp})(\varphi(\eta_p, T)) \tag{4}$$

Where $\overline{\rho Cp}$ and $Cp_g$ are defined as:

$$\overline{\rho Cp}=(1-\Phi)\rho_s Cp_s+\rho_g Cp_g \tag{5}$$

$$Cp_g=a+bT+cT^2. \tag{6}$$

Continuity Equation $$\frac{\partial \rho_g}{\partial t} + \frac{(\rho_g v_g)}{\partial z} = 0 \tag{7}$$

Ideal Gas Law $$\rho_g = \frac{P}{RT} \tag{8}$$

Ergun Equation $$\frac{dP}{dz} = -\frac{G}{\rho_g g_c D_p}\left(\frac{(1-\Phi)}{\Phi^3}\right)\left[\frac{150(1-\Phi)\mu}{D_p} + 1.75G\right] \tag{9}$$

The superficial mass velocity, G, in Equation 9 is defined as $$G = \rho_g \Phi v_g \tag{10}$$

Substituting Equation 10 into Equation 9 gives:

$$\frac{dP}{dz} = -\frac{v_g}{g_c D_p}\left(\frac{(1-\Phi)}{\Phi^2}\right)\left[\frac{150(1-\Phi)\mu}{D_p} + 1.75\rho_g \Phi v_g\right] \tag{11}$$

The initial and boundary conditions for semi-finite cylindrical specimen can be written as $$t=0\ 0<z<L{:}T=T_o, p=p_o, \eta=0, v_g=0 \tag{12}$$

$$t>0 z=0{:}T=T_c, p=p_h \tag{13}$$

$$z = L{:}\ \frac{dT}{dz} = 0,\ \frac{dp}{dz} = 0 \tag{14}$$

It is convenient from the numerical analysis point of view to rewrite the governing equations 2 through 14 into dimensionless forms. The exponential function in the reaction rate expression, Equation 3, may be approximated using the Frank-Kamenetskii approximation written as follows [15]:

$$\exp\left(-\frac{E}{RT}\right) = \exp\left(-\frac{E}{RT_c}\right)\exp\left(\frac{E(T-T_c)}{RT_c^2}\right) \tag{15}$$

Equation 15 was simplified into $$\exp\left(-\frac{E}{RT}\right) = \Re^{(\Theta-1)} \tag{16}$$

Where:

$$\Re = \exp\left(\frac{E}{RT_c}\right) \tag{17}$$

Thus, the governing equations in dimensionless form are:

Mass Balance $$\frac{\partial \eta_p}{\partial \tau} = t^* k_o (1-\eta_p)\Re^{(\Theta-1)} \tag{18}$$

Energy Equation $$\frac{\partial \Theta}{\partial \tau} + \Psi\frac{\partial \Theta}{\partial \xi} = \frac{\partial^2 \Theta}{\partial \xi^2} + Y(1-\eta_p)\Re^{(\Theta-1)} \tag{19}$$

Where:

$$\Psi = \frac{v_o \rho_{g_o} L v^* \rho^* Cp_g}{\lambda} \tag{20}$$

$$Y = \frac{L^2 \rho_s W'_{frac,Lim}(-\Delta H_{Rp})k_o}{M_{Lim}\lambda T_c} \tag{21}$$

Continuity Equation $$\frac{\partial \rho^*}{\partial \tau} + \Omega\frac{\partial(\rho^* v^*)}{\partial \xi} = 0 \tag{22}$$

Where:

$$\Omega = \frac{t^* v_o}{L} \tag{23}$$

Ideal Gas Law $$\rho^* = \zeta\frac{p^*}{\Theta+1} \tag{24}$$

Where:

$$\zeta = \frac{T_o}{T_c} \tag{25}$$

Ergun Equation $$\frac{dp^*}{d\xi} + \alpha v^{*2} + \beta v^* = 0 \tag{26}$$

Where:

$$\alpha = \frac{1.75 v_o^2 L \rho_{g0}}{p_0 g_c D_p}\left(\frac{(1-\Phi)}{\Phi}\right)\rho^* \tag{27}$$

$$\beta = -\frac{150 v_o L \mu}{p_o g_c D_p^2}\left(\frac{(1-\Phi)^2}{\Phi^2}\right) \tag{28}$$

The initial and boundary conditions can be rewritten as;

$$\tau = 0\ 0 < \xi < 1 : \Theta = \frac{T_o - T_c}{T_c},\ p = 1,\ \eta = 0,\ v^* = 0 \tag{29}$$

$$\tau > 0\ \xi = 0 : \Theta = 0,\ p = \frac{p_h}{p_o} \tag{30}$$

$$\xi = 1 : \frac{d\Theta}{d\xi} = 0,\ \frac{dp^*}{d\xi} = 0 \tag{31}$$

The dimensionless variables and parameters used in Equations 15 through 31 are well-defined in the related art nomenclature. For simulation purposes, the first and second order spatial derivates were approximated by an upwind and a central finite different scheme, respectively [11, 12].

Using the foregoing models, the reaction between the delay composition powders can be considered using the kinetic and physico-chemical data taken from the above empirical results. Numerically calculated dynamic profiles of dimensionless velocity, temperature, pressure, density, and conversion profiles were derived, and a good qualitative agreement between the experimental results and numerical calculations was found regarding the effect of gas pressure gradient on the propagation velocity. It was observed that as gas pressure increases the propagation becomes faster.

Actual Experimental Testing Data

Experimental (actual) data was collected on combustion front propagation characteristics in Si—Al—$Fe_3O_4$ delay columns. These propagation characteristics were investigated at 70° F., −65° F., and 200° F. The major measurement effort was on the following compositions (70 wt % $Fe_3O_4$—this composition was kept constant, Si (20–30 wt %), and Al (0–10 wt %).

Silicon burns well with Fe3O4 in a wide range of concentrations as specified above. However, when the temperature was significantly lower e.g. −65F the range of concentration was significantly narrowed and the Si—Fe3O4 mixture without the addition of aluminum had the tendency not to propagate or propagate in so called oscillatory regime (unstable). The addition of small amount aluminum significantly widened the concentration range for propagation at very low temperatures, which were as important as room or elevated conditions. Therefore, aluminum was used as an additional fuel to allow tunability of combustion front propagation characteristics, especially propagation velocity. The capability of tuning the propagation velocity was very important for design of different delay columns. In studies, aluminum content was varied from 0 to 10 wt %. At higher aluminum concentrations (above 10%) the propagation velocity was much higher than that desired for delay columns. In addition, the combustion temperature increased significantly causing some additional product gasification and therefore possibilities of disintegration of a column prior to the completion of the combustion process. Accordingly, this behavior would be catastrophic from the point of view of the performance of such delay columns. Therefore, the use of aluminum concentrations above 10 wt % is ineffective.

An extra benefit of the addition of Al was the improvement of a structural strength and column pressability and integrity when exposed to vibration or during the combustion process. Based on the tests as indicated below, the use of aluminum in an exemplary range between 0 to about 10 wt % is feasible, and in another exemplary embodiment, aluminum in a range of about 1-about 7 wt % may be used to produce a stable combustion front propagation, and in another exemplary embodiment, aluminum in a range between about 1- about 5 wt % may be used to obtain a more effective tunability range for Si—Al—Fe3O4 delay columns, and in a further exemplary embodiment, aluminum in a range between about 1-about 2.5 wt % may be used for meeting propagation velocities of specific applications.

Figure 5:
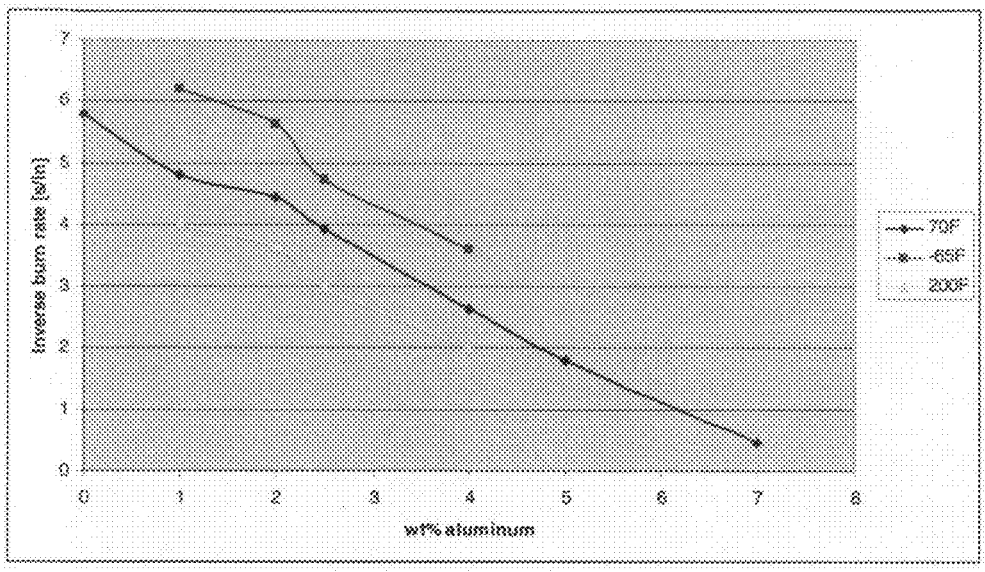
FIG. 5 is a plot of experimental test data of the inverse burn rate as the function of Al composition (wt %) in a mixture consisting of 70 wt % $Fe_3O_4$ and the balance being silicon.

Specifically, in Tables 3-10 and FIG. 5, the results indicated that no addition of aluminum into the Si—$Fe_3O_4$ mixture made this system less reliable at low temperatures (e.g. −65F), which was unacceptable (possible no fires). Accordingly, the effect was investigated with the addition of the aluminum powder. The testing indicated that the performance was very reliable when the composition of aluminum was approximately (about) above 1 wt %. The best performance for specific application, which satisfied inverse burn requirements, was between 1 wt % Al and 2.5 wt % Al. Further, the combustion front propagation was still stable up to 5 wt %. The combustion from propagation was still stable up to 7 wt % aluminum but the inverse burn rate was too small, which means that the combustion front propagated quite fast. At higher aluminum (Al) concentrations, the combustion front was very fast and, due to much higher temperatures generated by the system, the performance of the delay column was by far less stable resulting in expulsion of a part of reacted and unreacted material from the aluminum body and its partial melting. Therefore, the range above 7 wt % was not studied extensively. The results of inverse burn rate as the function of Al composition (wt %) in the mixture consisting of 70 wt % $Fe_3O_4$ and the balance of silicon are presented in FIG. 5.

Below in Tables 3—X are selected data for multiple measurements of inverse burn rate as the function of Al composition in the mixture consisting of 70 wt % $Fe_3O_4$ and the balance of silicon.

TABLE 3

Inverse burn rates for Si—$Fe_3O_4$ without aluminum.

Fired on Dec. 30, 2005 (70 F.)
Thermite Tubes
70 wt % Fe3O4 (Rockwood (old))
30 wt % Si (Elkem)

| Tube | Burn Time (Sec) |
|---|---|
| 1 | 5.6 |
| 2 | 6.24 |
| 3 | 6.336 |
| 4 | 6.248 |
| 5 | 6.24 |
| 6 | 6.496 |
| 7 | 6.336 |
| 8 | 6.608 |
| 9 | 6.16 |
| 10 | |
| Average | 6.25 |
| std dev | 0.28 |
| Cv | 4.50 |
| Range | 1.01 |

150 × 150 304 Stainless Steel mesh on bottom
all footage shot at 125 frames per second

TABLE 4

Inverse burn rates for Si—$Fe_3O_4$ with aluminum (1 wt %).

Fired on Jan. 10, 2006 (70 F.)
Thermite Tubes
70 wt % Fe3O4 (Rockwood)
29 wt % Si (Elkem) (Milled for 30 minutes)
1 wt % Al (Valimet)

| Tube | Burn Time (sec) |
|---|---|
| 1 | 4.184 |
| 2 | 4.792 |
| 3 | 4.616 |
| 4 | 5.392 |
| 5 | 4.464 |
| 6 | 5.048 |
| 7 | 5.12 |
| 8 | 4.864 |
| 9 | 5.048 |
| 10 | 5.04 |
| Mean | 4.86 |
| std dev | 0.35 |
| Cv | 7.30 |
| Range | 1.208 |

Fired at Room Temperature
Timing done with high speed camera at 125 frames per second

TABLE 5

Inverse burn rates for Si—$Fe_3O_4$ with aluminum (2 wt %) at 70° F.

Fired on Mar. 22, 2006 70 F.
Thermite Tubes
70 wt % Fe3O4 (AEE Micron)
28 wt % Si (Elkem)
2 wt % Al (Valimet)

| Tube | Burn Time (sec) |
|---|---|
| 1 | 4.384 |
| 2 | 4.43 |
| 3 | 4.504 |
| 4 | 4.42 |
| 5 | 4.47 |
| 6 | 4.36 |
| 7 | 4.416 |
| 8 | 4.4 |
| 9 | 4.608 |
| 10 | 4.464 |
| Mean | 4.45 |
| std dev | 0.07 |
| Cv | 1.60 |
| Range | 0.248 |

40,000 psi packing pressure
Fired at 70° F.
New Packing Technique was used

TABLE 6

Inverse burn rates for Si—$Fe_3O_4$ with aluminum (2 wt %) at −65° F.

Fired on Apr. 6, 2006
Thermite Tubes
70 wt % Fe3O4 (AEE Micron)
28 wt % Si (Elkem)
2 wt % Al (Valimet)

| Tube | Burn Time (sec) |
|---|---|
| 1 | 6.416 |
| 2 | 6.064 |
| 3 | 6.032 |
| 4 | 5.512 |
| 5 | 5.544 |

TABLE 6-continued

Inverse burn rates for Si—$Fe_3O_4$ with aluminum (2 wt %) at −65° F.

| | |
|---|---|
| 6 | 5.304 |
| 7 | 5.448 |
| 8 | 5.248 |
| 9 | 5.544 |
| 10 | 5.416 |
| Mean | 5.65 |
| std dev | 0.38 |
| Cv | 6.78 |
| Range | 1.168 |

40,000 psi packing pressure
Fired at −65° F.

TABLE 7

Inverse burn rates for Si—$Fe_3O_4$ with aluminum (2 wt %) at 200° F.

Fired on Apr. 10, 2006
Thermite Tubes
70 wt % Fe3O4 (AEE Micron)
28 wt % Si (Elkem)
2 wt % Al (Valimet)

| Tube | Burn Time (sec) |
|---|---|
| 1 | 3.48 |
| 2 | 3.48 |
| 3 | 3.656 |
| 4 | 3.808 |
| 5 | 3.632 |
| 6 | 3.608 |
| 7 | 3.688 |
| 8 | 3.64 |
| 9 | 3.824 |
| 10 | 3.496 |
| Mean | 3.63 |
| std dev | 0.12 |
| Cv | 3.40 |
| Range | 0.344 |

40,000 psi packing pressure
Fired at 200° F.

TABLE 8

Inverse burn rates for Si—$Fe_3O_4$ with aluminum (2.5 wt %) at 70° F.

Fired on May 16, 2006
Thermite Tube
70 wt % $Fe_3O_4$ (AEE)
27.5 wt % Si (Elkem)
2.5 wt % Al (Valimet)

| Tube | Burn Time (sec) |
|---|---|
| 1 | 3.96 |
| 2 | 3.896 |
| 3 | 3.776 |
| 4 | 3.744 |
| 5 | 3.856 |
| 6 | 3.992 |
| 7 | 3.944 |
| 8 | 4.008 |
| 9 | 3.92 |
| 10 | 3.816 |
| Average | 3.891 |
| std dev | 0.091 |
| Cv | 2.330 |
| range | 0.264 |

Fired at 70° F.

TABLE 9

Inverse burn rates for Si—$Fe_3O_4$ with aluminum (2.5 wt %) at −65° F.

Fired on Jun. 12, 2006
Thermite Tube Fired at −65 F.
70 wt % $Fe_3O_4$ (AEE)
27.5 wt % Si (Elkem)
2.5 wt % Al (Valimet)

| Tube | Burn Time (sec) | IBR (sec/in) |
|---|---|---|
| 1 | 4.808 | 5.18 |
| 2 | 4.816 | 5.19 |
| 3 | 4.872 | 5.25 |
| 4 | 4.72 | 5.09 |
| 5 | 4.872 | 5.25 |
| 6 | 4.632 | 4.99 |
| 7 | 4.688 | 5.05 |
| 8 | 4.744 | 5.11 |
| 9 | 4.912 | 5.29 |
| 10 | 4.488 | 4.84 |
| Average | 4.76 | 5.12 |
| std dev | 0.13 | 0.14 |
| Cv | 2.72 | 2.72 |
| range | 0.42 | 0.46 |

TABLE 10

Inverse burn rates for Si—$Fe_3O_4$ with aluminum (2.5 wt %) at 200° F.

Fired on Jun. 19, 2006
Thermite Tube Fired at 200 F.
70 wt % $Fe_3O_4$ (AEE)
27.5 wt % Si (Elkem)
2.5 wt % Al (Valimet)

| Tube | Burn Time (sec) | IBR (sec/in) |
|---|---|---|
| 1 | 2.992 | 3.22 |
| 2 | 3.072 | 3.31 |
| 3 | 2.912 | 3.14 |
| 4 | 2.816 | 3.03 |
| 5 | 2.936 | 3.16 |
| 6 | 2.952 | 3.18 |
| 7 | 2.96 | 3.19 |
| 8 | 2.864 | 3.09 |
| 9 | 2.752 | 2.97 |
| 10 | 2.896 | 3.12 |
| Average | 2.92 | 3.14 |
| std dev | 0.09 | 0.10 |
| Cv | 3.11 | 3.11 |
| range | 0.32 | 0.34 |

It should now be apparent that the present pyrotechnic delay compositions provide non-toxic, environment-friendly delay compositions that replace toxic alternatives such as Manganese Delay (MIL-M-21383), Tungsten Delay (MIL-T-23132) and other pyrotechnic delays containing carcinogenic hexavalent chromates. The present blends burn substantially gas-free, are safe to handle, are resistant to moisture and degradation over time, can be incorporated within the confines of existing fuze explosive trains, and that pose no environmental hazards.

Having now fully set forth the exemplary embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

We claim:

1. A delay fuse, comprising:

a shell being closed at both ends;

a percussion cap being located in said shell;

a first ignition charge being in fluid communication with said percussion cap inside said shell;

a pyrotechnic delay composition being in fluid communication with said first ignition charge inside said shell, said pyrotechnic delay composition comprises Si—Al—$Fe_3O_4$;

a second ignition charge being in fluid communication with said pyrotechnic delay composition inside said shell; and an output charge being in fluid communication with said second ignition charge for detonating a payload, wherein said shell is a cartridge shell.

* * * * *